United States Patent [19]

Krakauer

[11] 4,361,092

[45] Nov. 30, 1982

[54] PROCESS AND APPARATUS FOR TIME CARD PREPARATION AND UTILIZATION AND THE LIKE

[75] Inventor: Lawrence J. Krakauer, Wayland, Mass.

[73] Assignee: Kronos, Incorporated, Boston, Mass.

[21] Appl. No.: 215,845

[22] Filed: Dec. 12, 1980

[51] Int. Cl.[3] ..... G06C 15/00

[52] U.S. Cl. ..... 101/426; 346/82; 235/419; 101/91; 101/93.01

[58] Field of Search ..... 101/90, 91, 93.01, 93.19, 101/426; 346/80, 82, 86; 35/377, 425, 432, 419, 487

[56] References Cited

U.S. PATENT DOCUMENTS

| | | | |
|---|---|---|---|
| 3,464,349 | 9/1969 | Ritzerfeld | 101/91 |
| 3,740,759 | 6/1973 | McKeegan et al. | 346/82 X |
| 3,894,215 | 7/1975 | Lotter et al. | 235/377 |
| 4,011,434 | 3/1977 | Hockler | 235/377 |
| 4,058,056 | 11/1977 | Rubin | 101/93.19 |
| 4,270,043 | 5/1981 | Baxter et al. | 346/86 X |

OTHER PUBLICATIONS

Brochure: "The TIMEKEEPER Revolutionizes Payroll Processing," Kronos, Incorporated, Boston, Mass., 1979.

Bulletin B-110-464, "ETC Electronic Time Calculator," Simplex Time Recorder Co., Gardner, Mass., Jul. 1980.

Bulletin: "AMAC-TIME Computerized Time Recorder," Amano Corporation, Japan.

*Primary Examiner*—Edward M. Coven

*Attorney, Agent, or Firm*—Rines and Rines, Shapiro and Shapiro

[57] ABSTRACT

This disclosure is concerned with presequencing machine-readable time card identifications in the printing of decks of time cards, automatically using the time-recording clock to fill in corresponding human-readable identification, and with a correspondence map memory between machine-and-human readable identifications, enabling repetitive assignment of the machine-readable identification of subsequent decks of time cards to provide complete use of the decks by changing such assignment correspondence.

3 Claims, 1 Drawing Figure

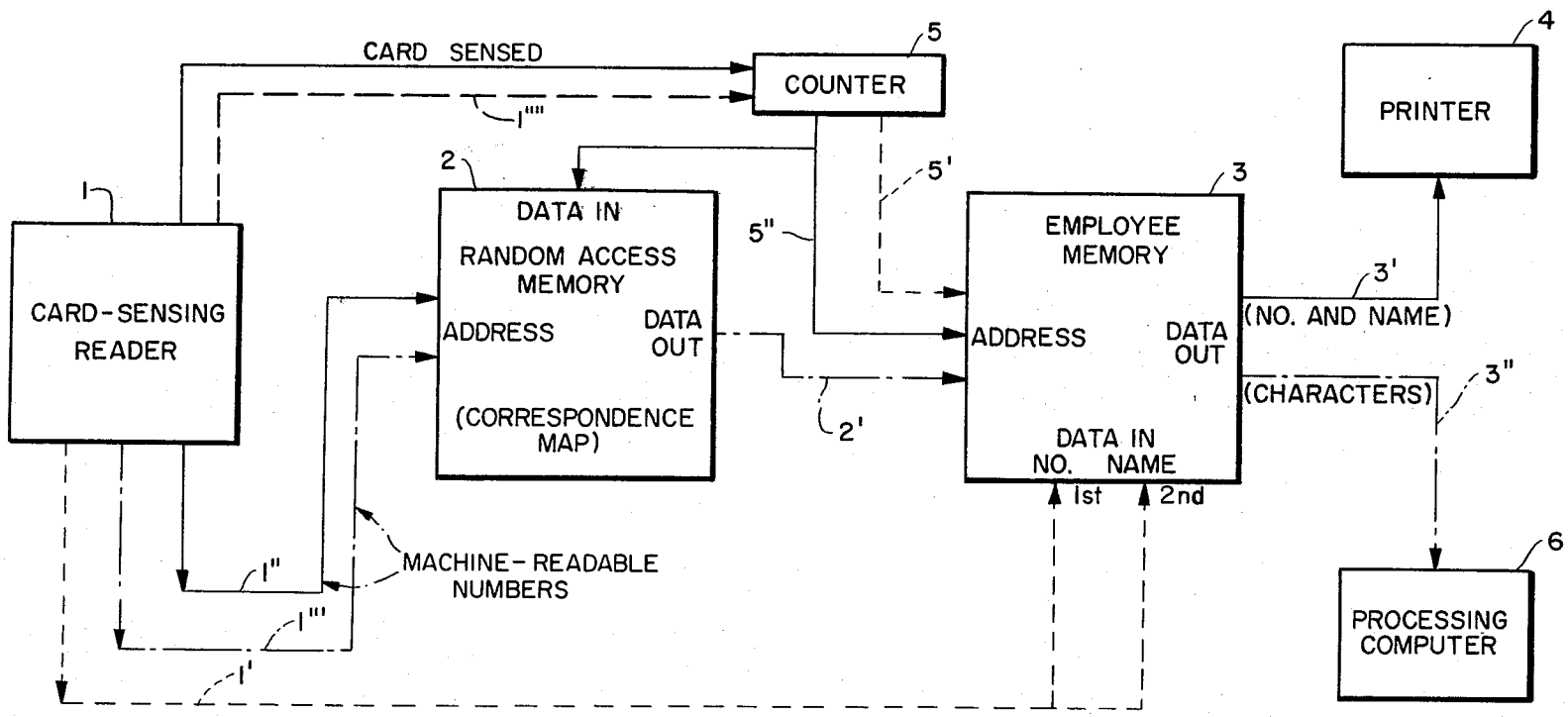
PRINTER
4
3'
(NO. AND NAME)
3"
(CHARACTERS)
PROCESSING COMPUTER
6
3
EMPLOYEE MEMORY
DATA OUT
ADDRESS
DATA IN
NO.
NAME
1st
2nd
5
COUNTER
5'
5"
2'
2
DATA IN
RANDOM ACCESS MEMORY
DATA OUT
ADDRESS
(CORRESPONDENCE MAP)
MACHINE-READABLE NUMBERS
CARD SENSED
1''''
1'''
1''
1'
1
CARD-SENSING READER

PROCESS AND APPARATUS FOR TIME CARD PREPARATION AND UTILIZATION AND THE LIKE

The present invention relates to time card and similar recording apparatus wherein cards representing employees or other similar groups of information are prepared and from time to time inserted for the printing of information relating to the moments of arrival and departure, and for indicating calculated summaries and the like, being more particularly directed to novel processes for more efficiently preparing and interactively using large numbers of such cards in these types of systems.

In co-pending application of the assignee of the present application, Kronos Incorporated, Ser. No. 20,223, filed Mar. 13, 1979, for METHOD OF AND APPARATUS FOR TIME CLOCK RECORDING AND COMPUTATION AND RELATED USES (now U.S. Pat. No. 4,270,043, issued May 26, 1981), and corresponding European Patent Office application Ser. No. 79 301449.9, now published on Oct. 1, 1980 on EPO Publication No. 0016276, a very successful time recorder of this character is described, manufactured by such assignee, and described also in its "TIMEKEEPER" Service, Operator's, and Progammer's Manuals of 1980. In accordance with this type of apparatus, a computation system is provided that enables mark-sense identification of particular cards associated with particular employees and the automatic printing of time-in and time-out and hours of work, as well as other functions that enable the apparatus to be used for direct payroll accounting and the like if desired. Similar though less facile apparatus has been manufactured and marketed by others such as, for example, the ETC Electronic Time Calculator described in Bulletin B110464 of July, 1980 of Simplex Time Recorder Co. of Massachusetts, and the Amac-Time Computerized Time Recorder of Amano Corporation of Yokohama, Japan described in its bulletin of the same title. In the Kronos "Timekeeper" time clock described in said applications, publication and manuals, machine-readable employee numbers are actually filled into a mark-sense grid at the bottom of the card. This requires, however, that each card be individually marked in the grid for each pay period, necessitating a rather lengthy manual process for the creation of the cards, and also necessitating human-readable name or other information to be separately filled in at the top of the card. In accordance with the present invention, on the other hand, this type of process is carried out by the clock itself, making use of standardized decks of presequenced cards. The manual card preparation phase is thus eliminated both for filling in the machine-readable mark-sense grid section of the card and for filling in the human-readable section of the card. The machine-readable section of the card in the invention is presequenced in the printing of the cards, and the human-readable section of the card is filled in automatically by the clock.

In machines of the type described in the before-mentioned complex and Amano publications, the machine-readable number is punched with standard holes at one end of the card and is the only identification of the employee available to the clock. These types of devices thus cannot print out reports or perform any such operations using human-readable number and name of the employee since such information is not available to these clocks. In the case of the Amano type clock, for example, the user is instructed to consider a three-digit clock number as the employee's number, and then uses these numbers over and over again, week after week, necessitating the discarding of cards if presequenced punched decks of cards are used. Such a procedure has the further problem that, as employees come and go, numbers will have to be re-assigned in order to have a gapless assignment of the deck. The assignment is completely fixed at any given moment and the user must consider the clock's number to be the user's number as well. In apparatus of the Simplex type, employees take a different card every week and write their name on top, but the assignment is not in any way given to the clock and the clock is thus not capable of printing out any management information reports or the like.

An object of the present invention, accordingly, is to provide a new and more efficient process and apparatus for card preparation and interactive utilization in the time clock apparatus that obviates the above disadvantages and, to the contrary, enables the time clock to be in possession of the human-readable form of the employee numbers and employee names so that it is capable of using these numbers and names in the printing of management information reports, and to do so with the further advantage that the decks of cards, which are customized for use week by week, are fully utilized without any necessity of discarding cards and without even the need for the end user of the time clock to note or use the machine-readable numbers on the cards.

A further object is to provide a novel process and apparatus for preparation and utilization of time cards or the like of more general application, as well, and novel cards prepared by such process.

Other and further objects will be explained hereinafter and are more particularly delineated in the appended claims. In summary, however, from one of its important aspects, the invention embraces a process for preparing and using employee time cards and the like with the aid of an electronic clock having card-sensing, memory and printing mechanisms, that comprises, preparing a deck of time cards each having different machine-readable identifications on the cards and for use over a predetermined time period such as a week; entering a list of employee identifications in the clock memory for reproduction in human-readable form; feeding a number of cards of the deck equal to the number of employees serially into the clock; causing the clock, as each card is fed into the same, to assign the machine-readable identification of that card to a corresponding employee identification; printing the employee identification in human-readable form on the corresponding card to customize the same for said time period; feeding the clock an additional number of cards from the deck for use in a subsequent time period to assign subsequent machine-readable identifications to corresponding employee identifications and printing the same on the cards so that the same employee identification appears in human-readable form on a second assigned card from the deck for use in such subsequent time period; and, upon having completely assigned the total deck, repeating the assignment of the machine-readable identification of a similar new deck to employee identifications to enable complete use of the decks by changing the assignment correspondence between the machine-readable identifications and the human-readable employee identifications.

The invention will now be described with reference to the accompanying drawing, the single FIGURE of which is a block diagram of apparatus assembled in accordance with a preferred embodiment of the invention and with process flow connections for each of employee list initialization entry, card preparation (such as on a weekly basis), and card utilization, separately illustrated. Preferred details and best mode embodiments are hereinafter presented.

Before proceeding to the illustrated embodiment, however, a more detailed explanation of the novel philosophy and approach underlying the invention is in order.

While time-and-attendance recording equipment (timeclocks, etc.) have traditionally been mechanical devices, within recent years electronic time-and-attendance recording equipment has evolved using computer technology to implement new functions such as totalling employee hours worked for the week, printing the total on the employee's card, and storing data about each employee electronically to allow access by management or another computer. This operation requires a time card assigned to each employee, similar to the card used in mechanical timeclocks, but for the purpose of accomplishing more sophisticated functions, such as totalling employee hours on the time card, the card must be different from the traditional mechanical time clock card at least in being provided with unique machine-readable codes. For such totalling timeclocks, a procedure called "card preparation" is done which results in a correspondence between machine-readable code number and employee data which is stored in the timeclock, and provides a human-readable identification on the time card so that an employee can read his or her name or number. The latter identification may be hand-written on the card or printed by the timeclock or printed by some other read-preparation system.

In prior systems, the customer is asked to assign sequential employee numbers to his employees, and purchases cards with numbers corresponding to the employee numbers. In such case, there is a one-to-one correspondence between timeclock-readable code number and employee data identification number. The drawbacks of such systems are that many cards are wasted unless the number of employees is identical with the number of printed cards in the supplied deck. Since only the lower-numbered cards are used to correspond to the number of employees, this reflects upon unnecessary inventory and printing costs. If an employee leaves, moreover, the user must reassign all higher-numbered employees to new numbers or must purchase even more cards.

In accordance with the present invention, it has been found possible to provide a card preparation and utilization process which uses a time card deck preprinted with machine-readable numbers from, for example, 1 to 500, with a technique for re-allocation of machine-readable numbers to human-readable employee numbers in such a manner as to use the entire deck. The method takes advantage of the existence of a computer inside the timeclock for assigning different timeclock-readable numbers to each employee number each week during the card preparation phase, and for storing the resulting correspondence table during the pay period (usually one week) until the next card preparation is done.

As an example, consider a user with 106 employees. Prior to the first card preparation phase (i.e. the first time the timeclock is used), the employee number sequence must be entered into the clock. This is done by putting the clock into "Employee Entry" mode and then inserting, serially in order, time cards with the employee identification (employee number and/or employee name) in machine-readable form. Subsequently, in the first card-preparation phase, 106 time cards, which should have 106 different machine-readable numbers, are fed into the timeclock, in any order. The timeclock assigns the number of the first entered card to the first employee, and stores the same in the correspondence table, continuing this process until the correspondence table has 106 entries. The most convenient way of making sure that the 106 timecards all have different numbers is to use the deck in order; so that time cards 1–106 may be used during the first pay period, and then timecards 107–212 may be used during the second pay period, and so on. The timeclock does not check ordering; but it does check that all cards used during a pay period are different, and rejects repeated entries of similarly numbered cards. While the size of the presequenced deck is nominally equal to the maximum number of employees, in practice, a presequenced deck of twice this size is useful to allow cards to be prepared in advance for the following pay period. No cards are wasted, and only one product needs to be inventoried; namely, a deck of, say, 1–500 cards, and with printing cost savings stemming from equal quantities of each different time card printed.

Another useful feature is that as each new card is inserted, the timeclock can not only create a correspondence table, but also can print the employee name on the card in a position where the employee can read it in the time card rack, such as at the top.

Since, in this example, the timeclock requires only 106 uniquely different machine-readable numbers, another alternate method is to provide the user with a deck of randomly (or pseudorandomly) numbered cards. If the number of different identifications is over a million, for example, the chance of detecting a duplicate number during a card-preparation for 100 employees is $10^{-4}$; and if a duplicate number is found, the duplicate card is simply discarded or returned to stock and the next card is used.

To provide a million different numbers, 20 bits can be used by marking, (say, blackening) 20 mark-sense boxes randomly on the card, or 10 decimal digits may be used in the one-of-10 mark-sense arrangement described in said applications and manuals. Principal further advantages of this alternate method are that the user does not need to keep his or her time card deck in any particular order, the printer does not have to collate card output accurately (shuffling is required), and the inventory can be in a loose pile rather than boxed in a predetermined quantity. The principal disadvantage, which can often be entirely acceptable, is that this pseudorandomly numbered deck cannot be created by standard printing and collating methods, but would have to be done by a computer-driven printer.

Turning, now, to the illustrative embodiment of the invention shown in the drawing, a time clock of the type described in said application and "Timekeeper" manuals is illustrated, embodying a card-sensing reader section 1, a printing section 4 cooperative therewith, to print upon the cards inserted in the reader 1, and an interactive computation section generally shown at 6 performing the storage, memory and control functions as therein described. Since the novelty of the invention does not reside in this basic apparatus, it is not herein reproduced in detail in order to avoid confusing the same with the novelty of the present invention (reference rather being made to said patent applications, publication and manuals for the basic known structure); the drawing illustrating fully the cooperative peripheral equipment and/or operation interacting in the novel manner of the invention with this now well-known commercial Kronos "Timekeeper" timeclock apparatus.

Referring to the drawing, the block 2 is a random access memory which is to serve the function of providing a correspondence map between machine-readable numbers and the employee memory storage unit 3. In accordance with the process of the invention, the first utilization of this system is in an "Employee Entry" mode involving the entry of the employee list.

The first time the timeclock is used, the user must inform the clock how many employees are to be accommodated and also assign employee numbers to each employee. At this time, also, the employee's name may be entered if desired. The timeclock computer will initialize a database consisting of a data record for each employee. This database will initially consist of employee number and possibly name, and, as the employee punches the timeclock during a pay period, as later described, the punch-time data will be added to that employee's record.

How this is done is depicted by the dash line connections shown in the drawing, as follows. The card reader 1 is used to enter the employee list, which comprises each employee's human-readable number and human-readable name. Two types of cards are used, one of which is used to enter the number; and a separate type of card with different markings on it, is used to enter the alphabetic name. As these cards are inserted during the employee entry phase at 1, as in the manner described in said patent applications, publication and manuals, as is now well known, data from the card reader 1 is routed via path 1' directly into the employee memory 3, of conventional form, with a counter 5 providing sequential addresses into the employee memory 3 at 5'. Thus the employee list is entered into this memory 3 and stored for later use. The counter addressing the employee memory 3 during this mode is incremented each time a new employee is read, via path 1''.

It is alternatively possible to use some means other than the card reader to enter the employee list, if desired.

The second phase or mode of operation is card preparation, which is done every pay period (generally weekly), and its control connections are shown in solid-line connections in the drawing. During this operation, a deck of prenumbered cards is chosen and fed one at a time into the timeclock. As each card is entered, the timeclock will check to be sure that the card's machine-readable number is unique for the current pay period; assign its machine-readable number to the next employee number, and enter the result in a correspondence table; and print the employee number or same on the card. The user then inserts the timecard in the card deck.

This card-preparation function is shown achieved by the before-mentioned solid-line connections in the drawing as follows. During this mode, the counter 5 is reinitialized to count down through the employee memory 3 at 5''. As each card is fed into the reader 1 from the deck in order, the machine-readable card number is routed at 1'' to the correspondence map memory 2. The incrementing counter 5 selects at 5'' the next available entry in the employee memory 3, and this entry is simultaneously printed on the card, by command along 3' to the printer 4, and written into the correspondence map memory 2 at the address input, so-labelled, as selected by the presequenced number on the card. Thus, the correspondence map is simultaneously built up in the correspondence map memory 2; and using the printer 4, the correspondence is printed on the presequenced card to customize it for a particular employee.

A typical memory content might be as follows:

| Correspondence Map (2) | | Employee Memory (3) |
|---|---|---|
| address | data | address data: employee #, name |
| . | | . |
| . | | . |
| . | | . |
| 127 | 64 | 102 069-31-4189 Smith, J. |
| 128 | 103 | 103 027-32-3875 Rogers, W. L. |
| 129 | 17 | 104 042-81-8111 Baker, J. P. |
| . | | . |
| . | | . |
| . | | . |

The third phase or mode of operation is use of the card during the pay period, generally a week, as before stated. This operation is illustrated by dash-dot connections in the drawing. As an employee punches in, by inserting the card in the reader 1, a different sequence of events takes place. As the card is inserted in the card reader 1, its machine-readable number is read, as described in said applications, publication and manuals and as is now well known, and is used to address the correspondence map memory 2 via path 1'''. The output (labelled "Data Out") of the map memory 2 feeds the corresponding employee number at 2', which is then used to access the correct employee data record in the employee memory 3. The employee data record is then read to determine where to hold the card and what to print on it by printer 4, as is also described in said applications, publication and manuals and is now well known. Thus, in summary, the card reader 1 presents the presequenced card number to the address of the correspondence map memory 2, which locates the corresponding employee in the employee memory 3, and the output of the employee memory 3 presents this employee's name and number to the computer 6 for processing.

The possibility of this kind of card preparation and utilization with its before-mentioned striking advantages remained hidden from those skilled in this art for some time until the present invention, possibly because the art was centered upon considering the machine-readable identification on the card as primary, rather than considering the desired human-readable identification as primary. In the previous systems, before discussed, essentially the identification that is used is that which is convenient for the machine; while in the system of the present invention, the identification that is used by the users of the system is that which is convenient for the user, with the machine taking care of all of the details of assigning the necessary correspondences so that the user need only to think in terms of the human-readable identification; that is, the human-readable number and the human-readable name. In this invention, the clock essentially manages the employee list in this human-readable form and takes care of all the details of assigning that employee list to standardized presequenced decks. In practice in the field, this has proven to be very popular, and has enabled the results that essentially no one need manually mark the cards, and there may be universal use of this method of card preparation.

When the human-readable identification is printed on the time card, it is useful to print it on the top edge of the time card in the convential fashion, so that the employee's name and number will be visible along the top edge when the cards are put into a standard time card rack. A convenient means for accomplishing this is to extend the card with a perforated tab (not shown) since the card hold and printer mechanisms may not be capable of otherwise printing along the very top edge. The card is then inserted upside down, and the human-readable identification is printed upside down just above the perforation of the tab. When the card is removed and the tab torn off, the identification is thus left right side-up along the top edge of the card.

Further modifications will also occur to those skilled in the art, including other well-known card-reading, printing and addressable memory devices than the particular preferred forms described in the documents referenced in the specification; and such are considered to fall within the spirit and scope of the present invention as defined in the appended claims.

What is claimed is:

1. A process for preparing and using employee time cards and the like with the aid of an electronic clock having card-sensing, memory and printing mechanisms, that comprises, preparing a deck of time cards each having different machine-readable identifications on the cards and for use over a predetermined time period such as a week; entering a list of employee identifications in the clock memory for reproduction in human-readable form; feeding a number of cards of the deck equal to the number of employees serially into the clock; causing the clock, as each card is fed into the same, to assign the machine-readable identification of that card to a corresponding employee identification; printing the employee identification in human-readable form on the corresponding card to customize the same for said time period; feeding the clock an additional number of cards from the deck for use in a subsequent time period to assign subsequent machine-readable identifications to corresponding employee identifications and printing the same on the cards so that the same employee identification appears in human-readable form on a second assigned card from the deck for use in such subsequent time period; and, upon having completely assigned the total deck, repeating the assignment of the machine-readable identification of a similar new deck to employee identifications to enable complete use of the decks by changing the assignment correspondence between the machine-readable identifications and the human-readable employee identifications.

2. A process as claimed in claim 1 and in which the cards of each deck are pre-sequenced by number to provide said different machine-readable identifications on the cards.

3. Apparatus for preparing and using decks of prepared employee time cards having different machine-readable identifications on the cards and for use over a predetermined time period such as a week; having, in combination, electronic clock means including card-sensing means, memory means, and printing means; means for entering a list of employee identifications into the memory means; means for feeding a number of cards of a first deck equal to the number of employees serially into the clock means; means for reading, as each card is fed into the same and sensed by the card-sensing means, the machine-readable identification of that card and for assigning the machine-readable identification of that card to a corresponding different one of the employee identifications; the printing means including means for printing in human-readable form on each card its corresponding employee identification to customize the same for said time period; means responsive to the feeding into the clock means of an additional number of cards from the deck for use in a subsequent time period for assigning the machine-readable identifications on such additional cards to corresponding employee identifications and for causing the printing means to print the same on the additional cards so that the same employee identification appears in human-readable form on a second assigned card from the deck for use in such subsequent time period; and means operable, upon having completely assigned the total deck, for assigning the machine-readable identifications of the cards of a second similar new deck to employee identifications, said last-named means comprising means for changing the assignment correspondence between the machine-readable identifications and the human-readable employee identifications to enable complete use of the decks.

* * * * *